US005640861A

United States Patent [19]

Chen

[11] Patent Number: 5,640,861

[45] Date of Patent: Jun. 24, 1997

[54] MOTORCYCLE LOCK

[75] Inventor: Ming-Chiao Chen, Tainan Shien, Taiwan

[73] Assignee: Rerlly Industry Co., Ltd., Tainan Hsien, Taiwan

[21] Appl. No.: 575,672

[22] Filed: Dec. 18, 1995

[51] Int. Cl.[6] ..... E05B 67/24

[52] U.S. Cl. ..... 70/38 A; 70/39; 70/233; 70/53

[58] Field of Search ..... 70/38 R, 39, 38 A, 70/38 B, 38 G, 45, 53, 35, 233

[56] References Cited

U.S. PATENT DOCUMENTS

| | | | |
|---|---|---|---|
| 957,033 | 5/1910 | De Bruycker | 70/38 A |
| 1,455,770 | 5/1923 | Anderson | 70/35 |
| 1,461,725 | 7/1923 | Cooper | 70/39 |
| 1,530,177 | 3/1925 | Heyer | 70/39 |
| 4,881,387 | 11/1989 | Kortenbrede | 70/39 |
| 5,230,231 | 7/1993 | Liou | 70/39 |
| 5,331,830 | 7/1994 | Su | 70/39 |
| 5,398,529 | 3/1995 | Goldman et al. | 70/39 |
| 5,417,032 | 5/1995 | Iu | 70/39 |

FOREIGN PATENT DOCUMENTS

| | | | |
|---|---|---|---|
| 0476229 | 3/1992 | European Pat. Off. | 70/39 |

*Primary Examiner*—Darnell M. Boucher

[57] ABSTRACT

A motorcycle lock consists of a housing containing a lock in an intermediate portion and two deadbolt bases in two lengthwise ends, two deadbolts on the deadbolt bases, an upper rotatable disc on the lock and a shackle. The shackle has two feet able to be inserted in two shackle holes in the housing and coil spring holes in the deadbolt bases and then separately locked by the deadbolts by rotating a key inserted in the lock. In unlocking the key is used to rotate the lock to free the two deadbolts from the two feet of the shackle.

1 Claim, 7 Drawing Sheets

MOTORCYCLE LOCK

BACKGROUND OF THE INVENTION

This invention concerns a motorcycle lock, and particularly a lock having two feet of a shackle able to be respectively kept locked, thus ensuring a locking effect and preventing it from being illegally pried open.

A known conventional motorcycle lock shown in FIGS. 1 and 2, has a U-shaped shackle 10, and one foot 11 thereof inserted in an oval hole 120, with a notch 110 engaging a stop 13 at one end of a cylindrical housing 12. And the other foot 14 of the shackle 10 is inserted in a round hole 121. Then a lock 16 is rotated with a key 15, forcing a rear post portion 17 rotate, with a curved stop plate 18 moved up to engage a slot 140 of the foot 14, finishing locking process. The shackle 10 is now unable to be pulled out from the housing 12, i.e. locked.

In unlocking the conventional motorcycle lock, the key 15 is used to rotate the lock 16, moving down the stop plate 18 to an original position, with the shackle 10 tilted to permit the notch 110 of the foot 11 to disengage from the stop 13. Then the shackle can be pulled out, completing the unlocking process.

However, the conventional motorcycle lock is found to have disadvantages as follows.

1. In locking, the shackle has to be inserted tiltingly in the housing. Otherwise, it is impossible to lock.

2. The shackle cannot be locked unless it is correctly inserted in the holes 120 and 121, as the notch 110 and the slot 140 have different directions.

3. The stop plate can only lock one foot of the shackle, so the preventive function against theft is not so good.

4. In unlocking, the notch cannot be disengaged from the stop, unless the shackle is tilted for a large angle, which is not easy to handle.

SUMMARY OF THE INVENTION

A motorcycle lock in the present invention has a housing shaped like an elongate case of a square cross-section, containing a lock in an intermediate portion of its hollow interior and two deadbolt bases respectively at two lengthwise ends. Two deadbolts are provided to be located on the deadbolt bases and supported with a projection as a pivot at its bent point. An upper rotatable disc is provided on an upper surface of the lock, and is rotated by a center rotatable body of the lock rotated by a key to push two engage ends of the deadbolts, which then rotate to force two actuating ends thereof to engage two slots of two feet of a U-shaped shackle inserted in two shackle holes of the housing and two coil spring holes of two deadbolt bases, and thus locking this motorcycle lock. In unlocking, the key is used to rotate the center rotatable body of the lock and the upper rotatable disc at the same time. Then the acutating ends can be moved to disengage from the slots of the two feet of the shackle, which is then sprung up by coil springs fitted in the coil spring holes of the two deadbolt bases and so far compressed by the two feet of the shackle, moving out of the shackle holes of the housing and the coil spring holes of the deadbolt bases.

BRIEF DESCRIPTION OF DRAWINGS

The invention will be better understood by reference to the accompanying drawings, wherein.

DESCRIPTION OF THE PREFERRED EMBODIMENT

Figure 1:
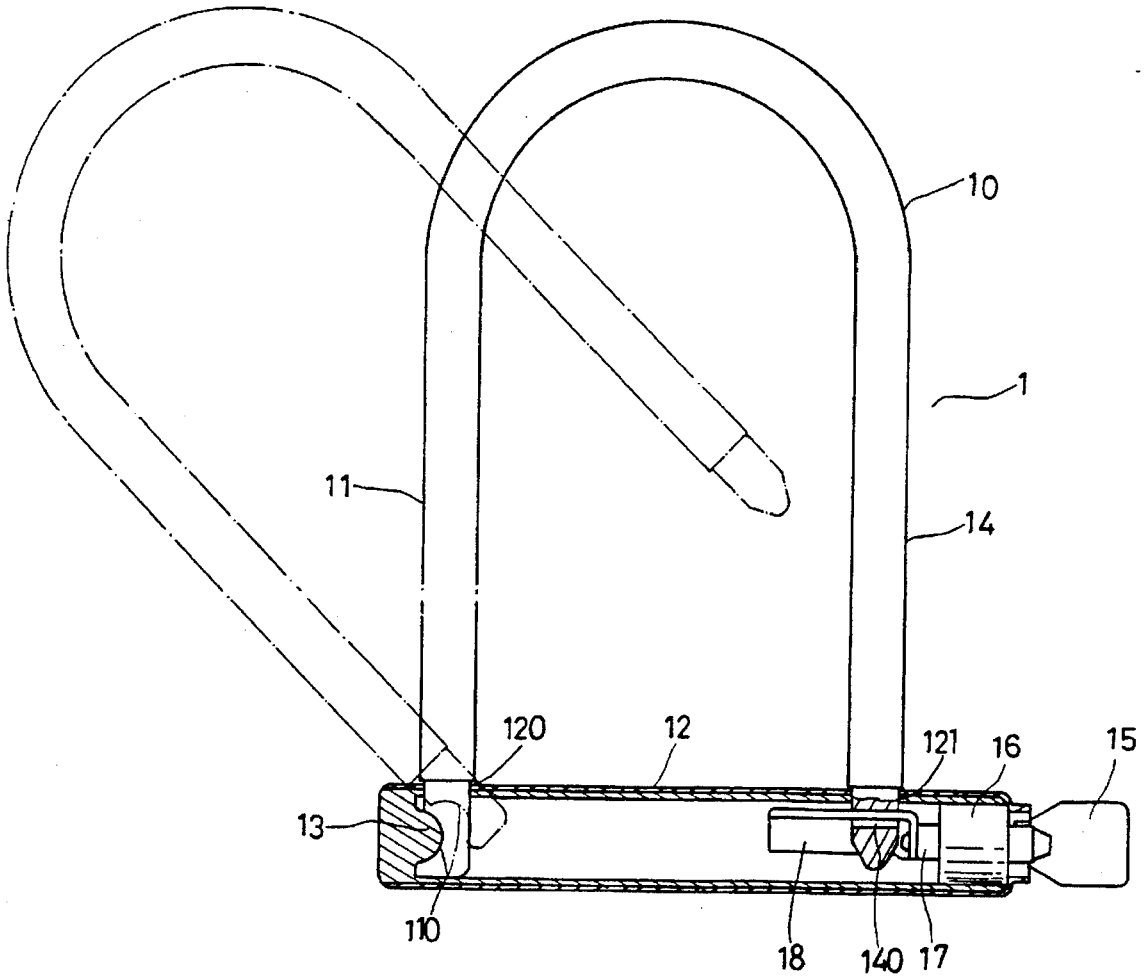
FIG. 1 (PRIOR ART)
FIG. 1 is a cross-sectional view of a known conventional motorcycle lock.
Figure 2:
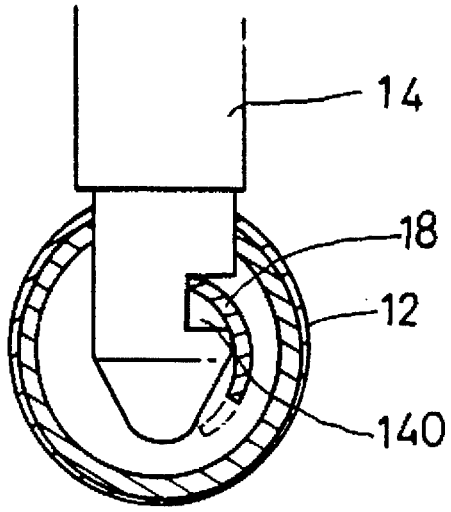
FIG . 2 (PRIOR ART)
FIG. 2 is a partial cross-sectional view of the known conventional motorcycle lock.
Figure 3:
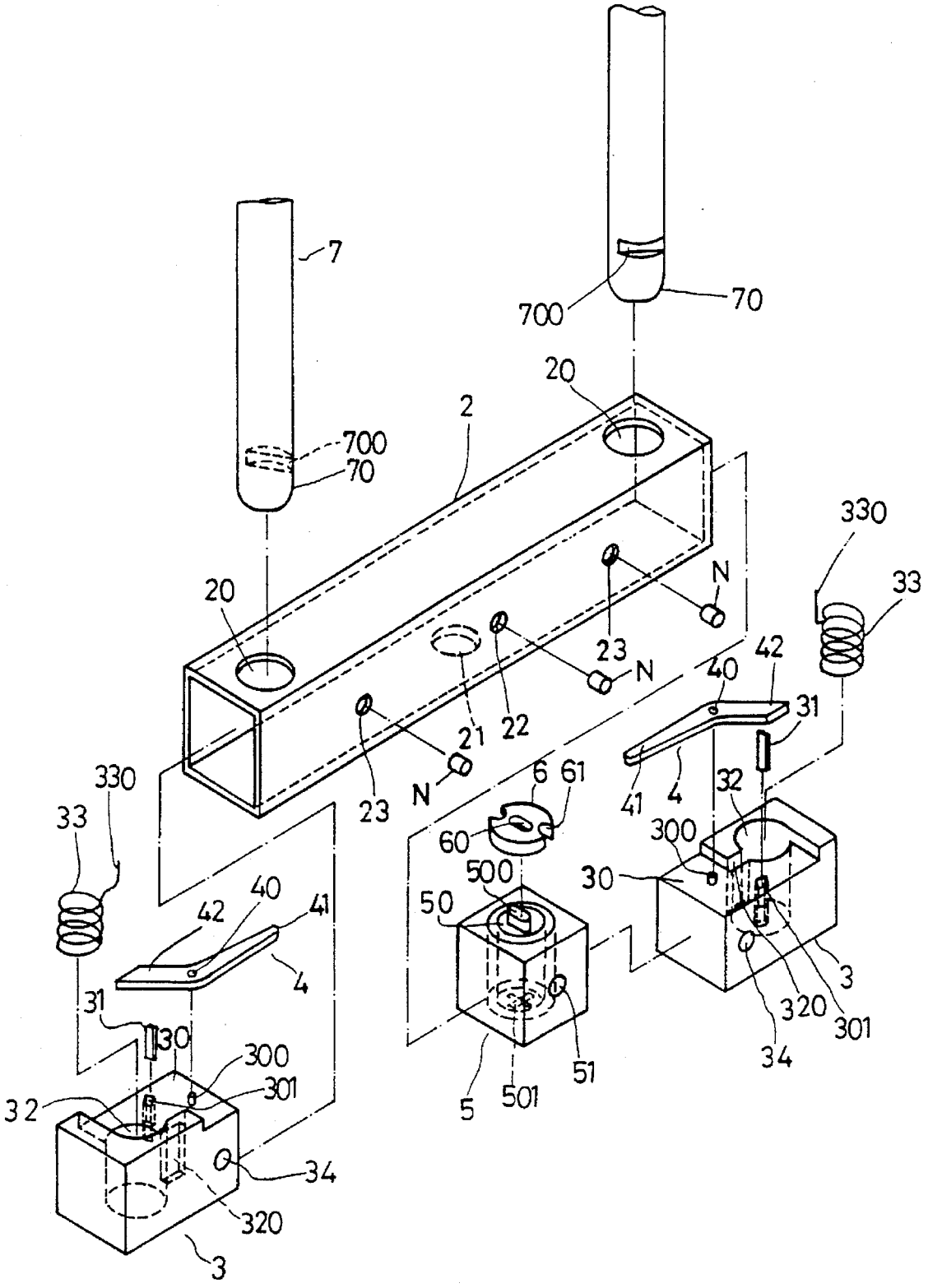
FIG. 3 is an exploded perspective view of a preferred embodiment of a motorcycle lock in the present invention.

A preferred embodiment of a motorcycle lock in the present invention, as shown in FIG. 3, consists of a housing 2, two deadbolt bases 3, 3, two deadbolts 4, 4, a lock 5, an upper rotatable disc 6, and a shackle 7 as main components combined together.

The housing 2 is shaped as a hollow elongate case of a square cross-section, having two lengthwise ends open, two shackle holes 20, 20 spaced apart in an upper side near two ends, a lock hole 21 in an intermediate portion of a bottom side, and a center pin hole 22 and two side pin holes 23, 23 respectively at two sides of the center pin hole 22 equally spaced apart in a front vertical side.

The two deadbolt bases 3, 3 are deposited to be located at a right side and a left side in the hollow interior of the housing 2, respectively having a recessed flat upper surface 30, a projection 300 on the recessed flat upper surface 30, a hole 301 in the recessed flat upper surface 30 for a plate spring 31 to fit therein and extending up the upper surface 30, a spring hole 32 provided vertically through each deadbolt base 3, a hole 320 of a rectangular cross-section communicating with the spring hole 32, a coil spring 33 deposited in the spring hole 32 and having its upper end 330 fitted in the vertical hole 320 and protruding a little up the upper surface 30, and a pin hole 34 provided in a front side.

The two deadbolts 4, 4 are respectively located on the upper surface 30 of each deadbolt base 3, having shape a bent angle, a pivotal hole 40 in an intermediate bent point, a pointed right engagement end 41 and an actuating left end 42.

The lock 5 is located in an intermediate portion of the hollow interior of the housing 2, having a center rotatable body 50, a projecting post 500 of an oval cross-section on the center of an upper surface of the rotatable body 50, a key hole 501 in a bottom surface of the rotatable body 50, and a pin hole 51 in a front side.

The upper rotatable disc 6 is located on the upper surface of the rotatable body 50 of the lock 5, having a center oval hole 60 to engage the post 500 of the lock 5, and two opposite notches 61, 61 in a peripheral edge.

The shackle 7 is U-shaped, having two feet 70, 70 and a crosswise slot 700 in each foot 70 near its end.

Figure 4:
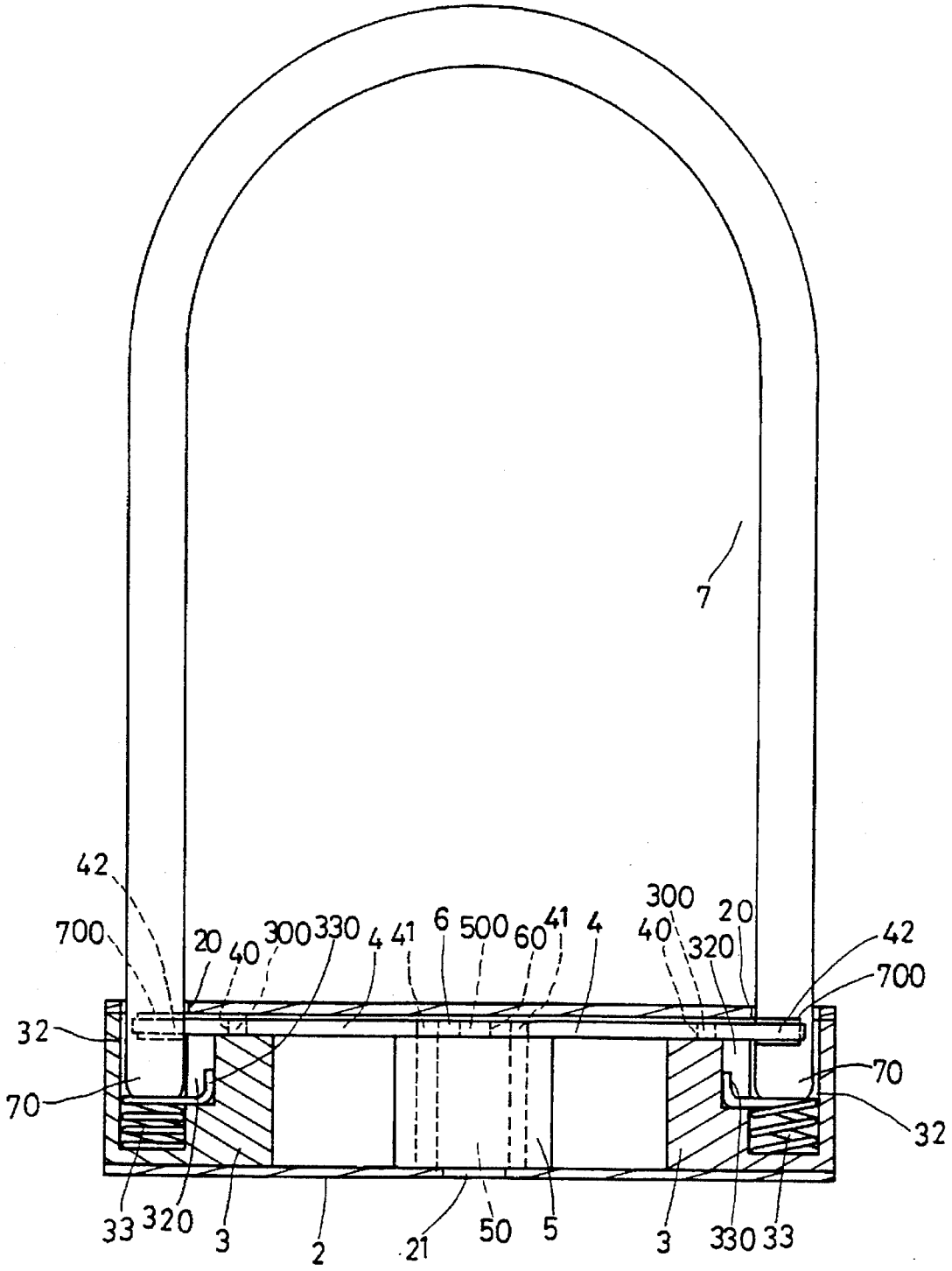
FIG. 4 is an elevational cross-sectional view of the preferred embodiment of a motorcycle lock in the present invention, showing it in a locked condition.
Figure 5:
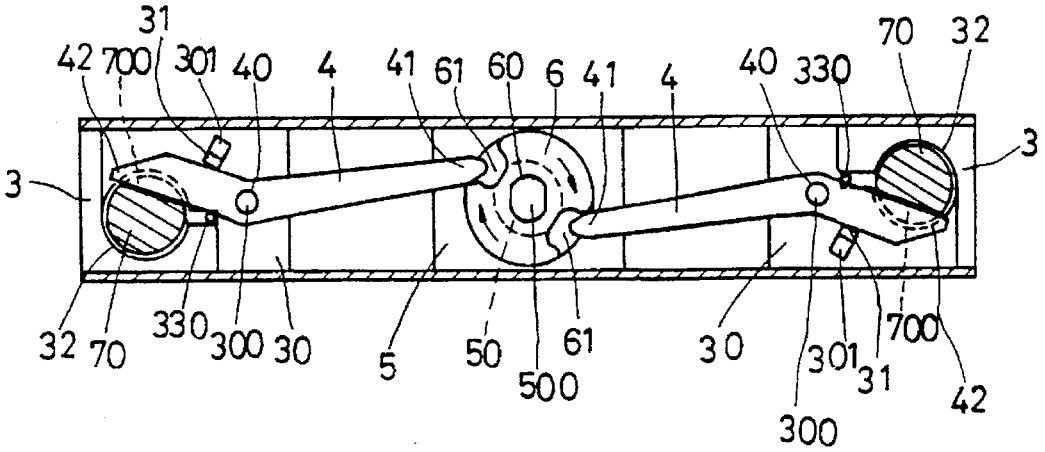
FIG. 5 is a plan cross-sectional view of the related components of the motorcycle lock in the present invention, showing same in the locked condition.

In assembling, referring to FIGS. 4 and 5, firstly the upper rotatable disc 6 is placed on the upper surface of the rotatable body 50 of the lock 5, with the oval hole 60 fitting around the projecting post 500. Then the lock 5 together with the upper roatatable disc 6 is inserted to be located in the intermediate portion of the hollow interior of the housing 2, with the key hole 501 aligned to the lock hole 21 of the housing 2, and with a pin N inserted in the pin holes 22 and 51. After that, the two deadbolts 4, 4 are respectively placed on the flat upper surface 30 of each deadbolt base 3, with the hole 40 fitting around the projection 300, with one side of the actuating left end 42 contacting and urging the plate spring 31 of each deadbolt base 3, and with the the side of of the actuating left end 42 being urged by the upper end 330 of the coil spring 33. Then the two deadbolt bases 3, 3 together with the two deadbolts 4, 4 and the two springs 33, 33 are respectively placed in two ends of the hollow interior of the housing 2, with each spring hole 32 aligned to the related shackle hole 20 of the housing 2, and with the right engagement end 41 respectively urging one of the notches 61, 61 of the upper rotatable disc 6, with the pin N inserted in pin holes 23 of the housing 2 and the pin holes 34 of the two deadbolt bases 3, 3 to secure the deadbolt bases 3, 3 with the housing 2. Lastly, the two feet 70, 70 of the shackle 7 are forced to enter the shackle holes 20, 20 of the housing 2, with the slots 700, 700 engaging the left actuating ends of the deadbolts 40, 40, being locked immovable. Then this lock is finished in assembling.

Figure 6:
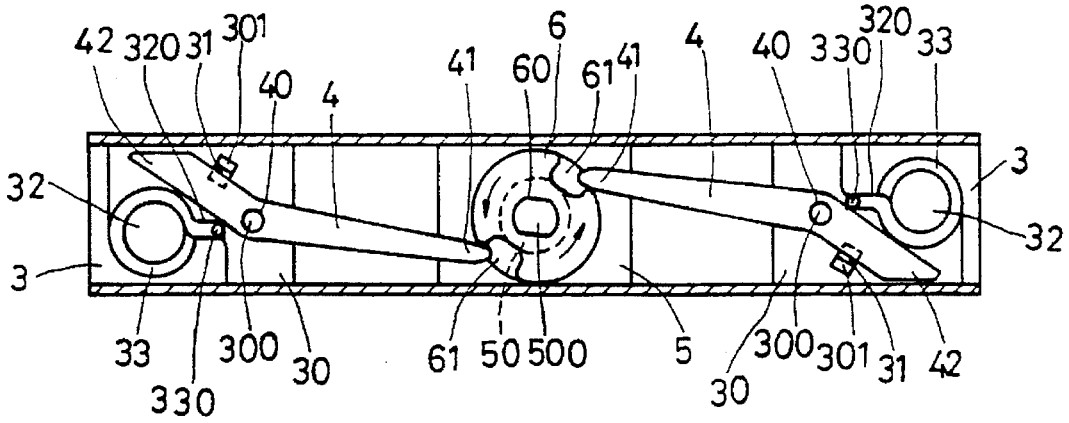
FIG. 6 is a plan cross-sectional view of related components of the motorcycle lock in the present invention, showing same in the unlocked condition.
Figure 7:
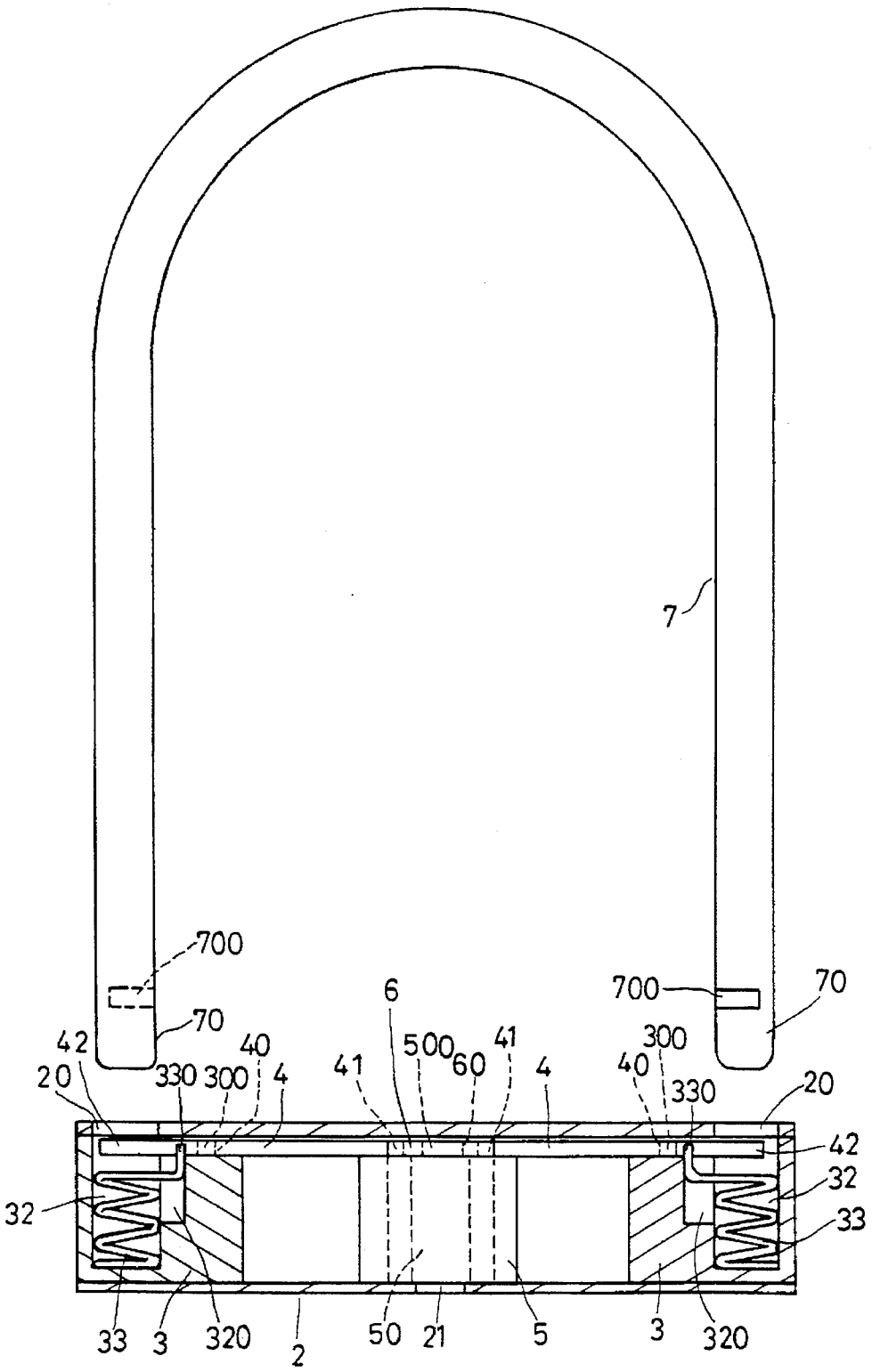
FIG. 7 is an exploded cross-sectional view of the motorcycle lock in the present invention, showing it being in an unlocked condition.

In using, referring to FIGS. 6 and 7, to unlock this motorcycle lock in the locked condition, a key is inserted in the key hole 501 of the rotatable body 50, and rotated clockwise, forcing the rotatable body 50 to rotate, with the projecting-up post 500 rotating the upper rotatable disc 6, with the two notches 61, 61 moving the engagement ends 41, 41 of the deadbolts 4, 4, with the actuating ends 42, 42 of the deadbolts 4, 4 gradually moving to disengage from the slots 700, 700 of the shackle 7, permitting the coil springs 33, 33 recover their resilience to lengthen up and spring the feet 70, 70 of the shackle 7 out of the spring holes 32, 32, with the upper ends of the coil springs 33, 33 moving up the upper surfaces 30, 30 of the deadbolt bases 3, 3 and hampering the actuating ends 42, 42, which then become unable to move back in the spring holes 32, 32. At the same time, the plate springs 31, 31 in the holes 301, 301 are pushed to bend rearward by the actuating ends 42, 42 of the deadbolts 4, 4, which are caught immovable between the upper end of the springs 33, 33 and the plate springs 31, 31 in the unlocked position.

Figure 8:
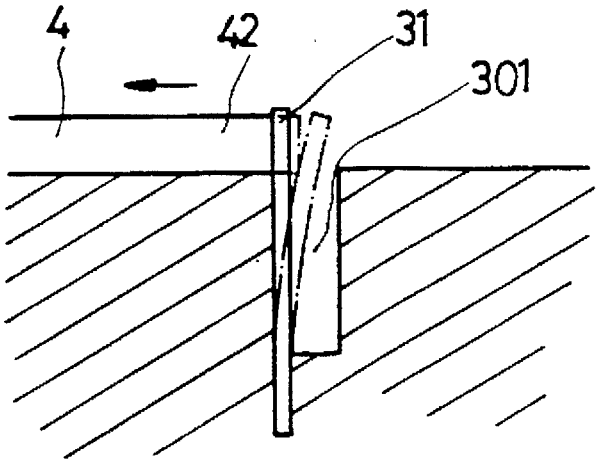
FIG. 8 is a partial cross-sectional view showing a plate spring in the motorcycle lock in the present invention, and how the plate spring moves in case of unlocking.

In locking this lock, referring to FIGS. 4 and 5, the shackle 7 is pushed down, with the feet 70, 70 moving down in the shackle holes 20, 20, and letting the ends 300 of the coil springs 33, 33 move down and disengage from the actuating ends 42, 42. Then the key is rotated counterclockwise to rotate the rotatable body 50, with the projecting-up post 500 rotating the upper rotatable disc 6 synchronously, which then rotates to force its notches 61, 61 to move the engagement ends 41, 41 of the deadbolts 4, 4 from the position shown in FIG. 6 to the position shown in FIG. 5. Then the plate springs 31, 31 in the holes 301, 301 push the actuating ends 42, 42 with its resilience as shown in FIG. 8. So the actuating ends 42, 42 move to engage the slots 700 of the feet 70, 70 of the shackle 7 already inserted in the coil spring holes 32, 32, which are then locked immovable, not able to be pulled out of the spring holes 32, 32 of the deadbolt bases 3, 3 and the shackle holes 20, 20 of the housing. Therefore, locking and unlocking of this lock can be completed quickly, conveniently and securely.

As can be understood from the above description, this motorcycle lock has merits as follows.

1. In locking, the two feet of the shackle can be respectively locked at the same time, securing locking function against anti-theft.

2. In locking, the plate springs can help secure the deadbolts 4, 4 with resilience.

3. In locking, the shackle has no other holes for inserting except the shackle holes, thus very convenient for handling.

4. The deadbolts are prevented from moving in the spring holes while in the unlocked condition, disturbed by the upper end and elasticity of the coil springs.

5. The components are simple, and convenient in assembling.

While the preferred embodiment of the invention has been described above, it will be recognized and understood that various modifications may be made therein and the appended claims are intended to cover all such modifications, which may fall within the spirit and scope of the invention.

What is claimed is:

1. A motorcycle lock comprising:

a) an elongate housing having two ends, a square cross-section, an upper side, a pair of spaced holes formed in the upper side, a bottom side, and a lock hole formed in the bottom side intermediate the two ends;

b) a pair of dead bolt bases disposed in the housing adjacent the pair of spaced holes, each base including a recessed flat upper surface, a first hole formed in the flat upper surface, a plate spring disposed in the first hole and protruding therefrom, a second hole extending vertically through the base and aligned with a hole in the upper side of the housing, a half through hole of rectangular cross-section communicating with the second hole, and a coil spring disposed in the second hole, the coil spring including an upper bent end for extension from and retraction in the second hole;

c) a dead bolt pivotally mounted on a projection of each dead bolt base, each dead bolt including an engagement end and an actuating end, the actuating ends being engageable by the upper ends of the coil springs in their extended positions for maintaining the dead bolts in an unlocked position;

d) a lock disposed within the housing adjacent the lock hole, the lock including a center rotatable body, a post projecting from the body, a disc supported on the post for rotation by the body, and the disc including a pair of opposed peripheral notches for engagement by the engagement ends of the dead bolts, whereby rotation of the disc in opposite directions disposes the dead bolts between locked and unlocked positions; and e) a shackle of U-shaped configuration, the shackle including two feet for insertion through the spaced holes of the housing and into engagement with the coil springs of the dead bolt bases, each foot having a slot formed therein, the slots being engageable by the actuating ends of the dead bolts when the coil springs are compressed and the upper bent ends thereof are retracted within the second holes to dispose the dead bolts in a locked position.

* * * * *